US006278789B1

(12) United States Patent
Potter

(10) Patent No.: US 6,278,789 B1
(45) Date of Patent: Aug. 21, 2001

(54) FREQUENCY SELECTIVE ACOUSTIC WAVEGUIDE DAMPING

(75) Inventor: Dewey Potter, Holliston, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 08/058,478

(22) Filed: May 6, 1993

(51) Int. Cl.[7] ..... H04R 25/00

(52) U.S. Cl. ..... 381/338; 381/348; 381/353; 381/395; 381/337; 181/189; 181/151; 181/187; 181/198

(58) Field of Search ..... 381/24, 158, 154, 381/90, 88, 337, 351, 338, 353, 348, 395; 181/156, 187, 189, 190, 179, 151, 198

(56) References Cited

U.S. PATENT DOCUMENTS

| | | | | |
|---|---|---|---|---|
| 2,905,259 | | 9/1959 | Ashe | 181/27 |
| 3,393,766 | | 7/1968 | Mitchell | 181/31 |
| 3,517,390 | | 6/1970 | Whitehead | 340/384 |
| 3,867,996 | | 2/1975 | Lou | 181/148 |
| 3,993,162 | | 11/1976 | Juuti | 181/156 |
| 4,164,988 | | 8/1979 | Virva | 181/156 |
| 4,628,528 | * | 12/1986 | Bose et al. | 381/90 |
| 4,807,293 | * | 2/1989 | Weckler | 381/159 |
| 4,837,837 | * | 6/1989 | Taddeo | 381/158 |
| 4,930,596 | * | 6/1990 | Saiki et al. | 181/156 |
| 5,170,435 | | 12/1992 | Rosen et al. | 381/86 |
| 5,373,564 | * | 12/1994 | Spear et al. | 381/159 |

FOREIGN PATENT DOCUMENTS

| | | | |
|---|---|---|---|
| 1 291 790 | | 4/1969 | (DE) . |
| 3028610 | * | 2/1982 | (DE) ..... 381/24 |
| 0 101 031 | | 2/1984 | (EP) . |
| 447749 | | 5/1936 | (GB) . |

OTHER PUBLICATIONS

David B. Weems, Labyrinth Speakers for Hi–Fi, Jan. 1972, Popular Electronics, vol. 1, No. 1.
European Patent Office Serch Report, dated Aug. 1, 1994.

* cited by examiner

*Primary Examiner*—Curtis Kuntz
*Assistant Examiner*—Dionne N. Harvey
(74) *Attorney, Agent, or Firm*—Fish & Richardson P.C.

(57) ABSTRACT

An acoustic waveguide loudspeaker system has an electroacoustical transducer having a vibratile surface. An acoustic waveguide has a first end open and a second end adjacent to the vibratile surface and an effective length corresponding substantially to a quarter wavelength at the lowest frequency of pressure wave energy to be transmitted between the first and second ends. Damping material in the waveguide near the vibratile surface is positioned so as to negligibly attenuate bass frequency energy while of sufficient volume to damp peaks at higher frequencies above the range of the bass frequency energy.

8 Claims, 3 Drawing Sheets

FREQUENCY SELECTIVE ACOUSTIC WAVEGUIDE DAMPING

BACKGROUND OF THE INVENTION

The present invention relates in general to an acoustic waveguide loudspeaker system generally of the type disclosed in Bose U.S. Pat. No. 4,628,528 incorporated by reference herein and more particularly concerns an acoustic waveguide loudspeaker system having damping.

SUMMARY OF THE INVENTION

According to the invention, there is an acoustic waveguide having an electroacoustical transducer at one end and open at the other with damping material, such as polyester in a small portion of the acoustic waveguide near the electroacoustical transducer.

Other features, objects and advantages will become apparent from the following detailed description when read in connection with the accompanying drawings in which:

DETAILED DESCRIPTION

Figure 1:
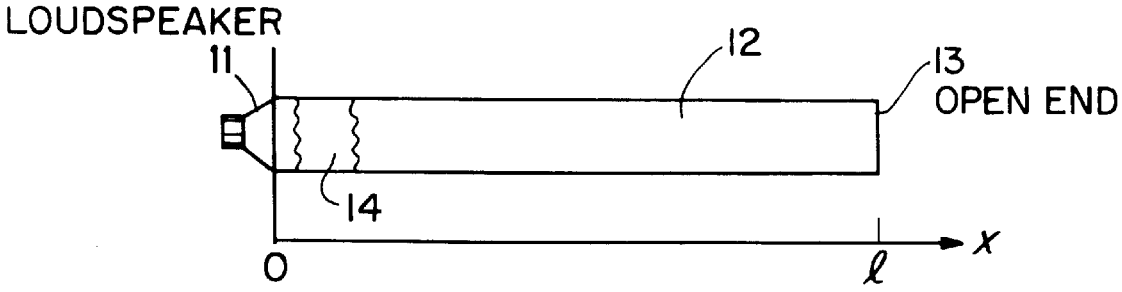
FIG. 1 is a diagrammatic representation of a loudspeaker driver at one end of a hollow hard tube acoustic waveguide with damping material near the driver.

With reference now to the drawing and more particularly FIG. 1 thereof, there is shown a diagrammatic representation of a loudspeaker driver 11 at one end of a hard tube 12 which may have substantially 55–60% the cross-sectional area of driver 11 and functioning as an acoustic waveguide of length 1 having an open end 13 that radiates waves launched at the other end by driver 11 with damping material 14 near driver 11.

Figure 2:
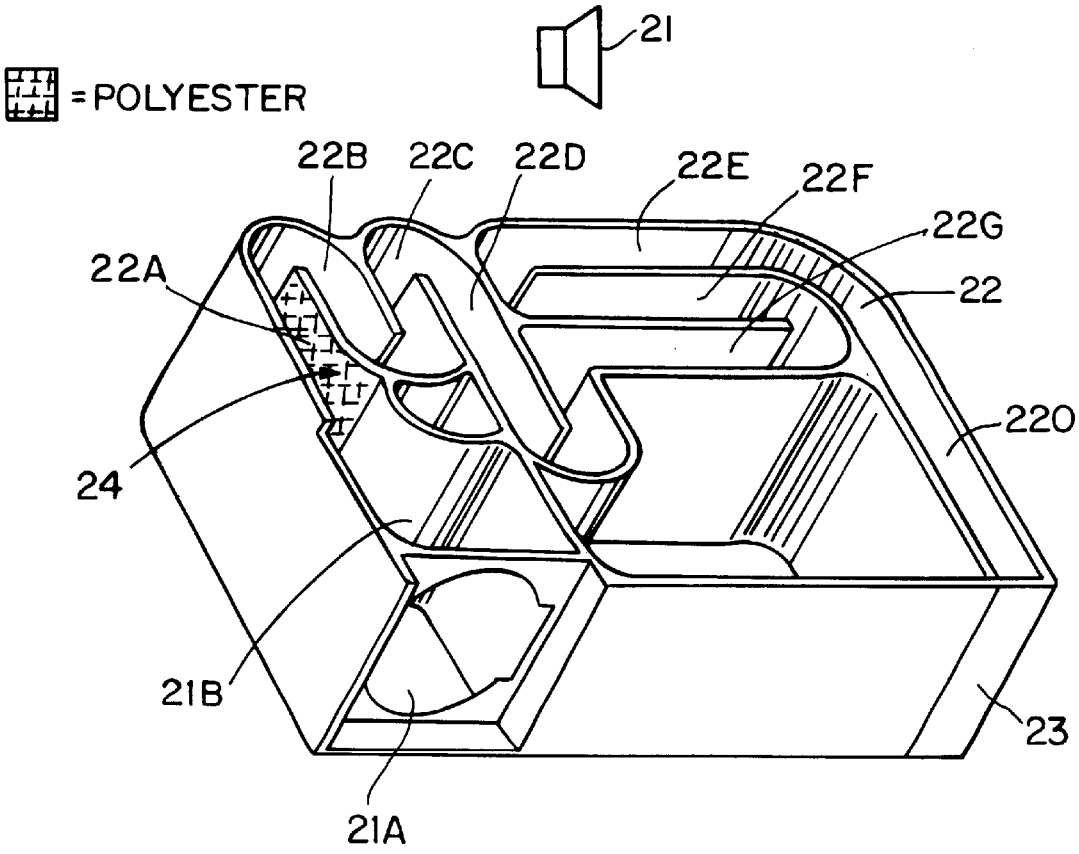
FIG. 2 is a perspective view with top removed of an exemplary embodiment of the invention.

Referring to FIG. 2, there is shown a perspective view of an embodiment of the invention suitable for formation in a table receiver. Driver 21 is seated in opening 21A of acoustic waveguide 22 having open end 23. Polyester damping material 24 fills the section of waveguide 22 adjacent to the driver compartment portion 21B of waveguide 22.

Figure 3:
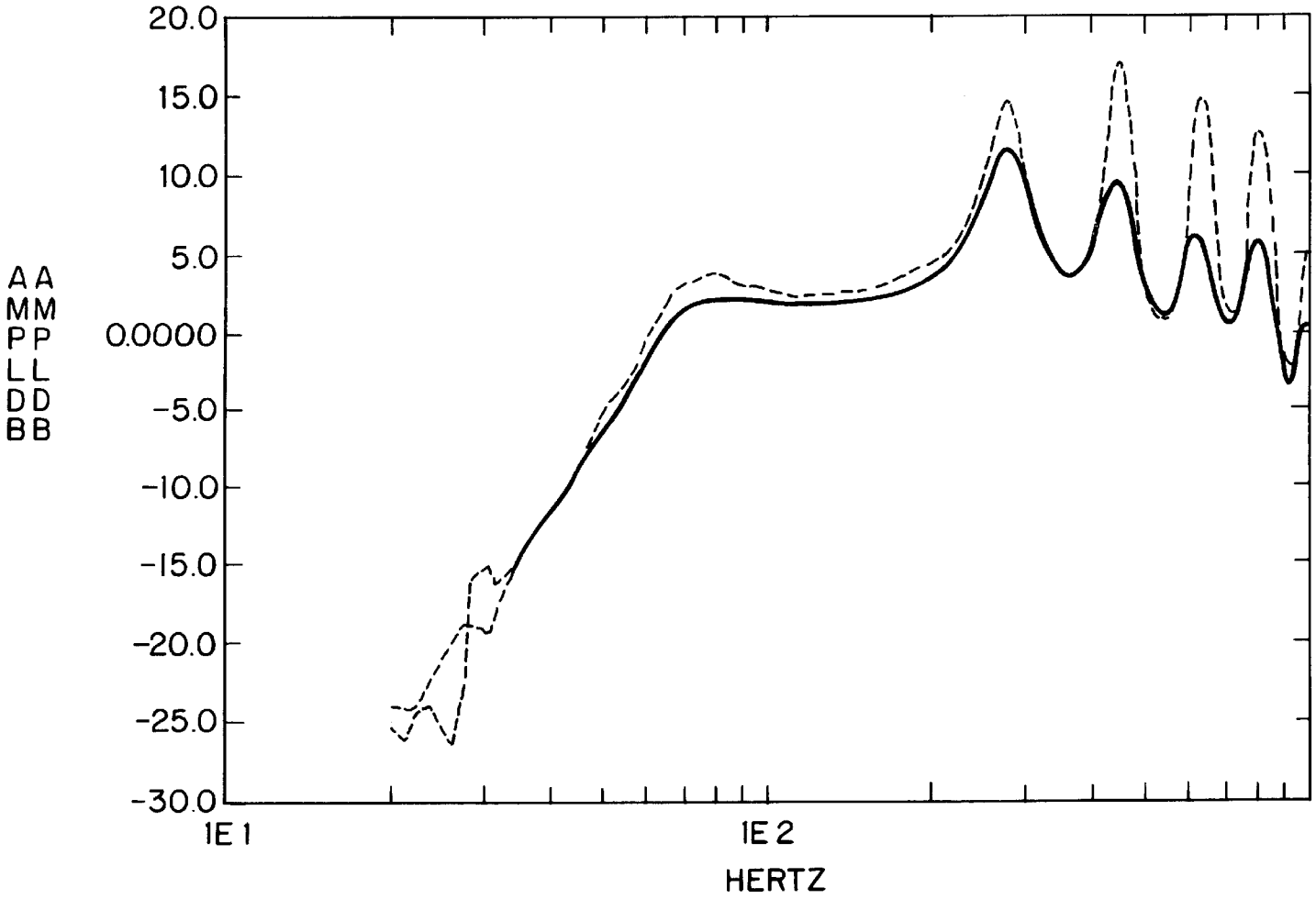
FIG. 3 is a graphical representation of pressure response as a function of frequency of the embodiment of FIG. 2.

Referring to FIG. 3, there is shown a graphical representation of the pressure response as a function of frequency of the embodiment of FIG. 2 with polyester damping material 24 as shown represented by the heavy trace and without damping material 24 as represented by the lighter trace.

One approach for reducing peaks is to use foam E blocks and/or T blocks at certain points in the waveguide where there is high velocity for that peak. It was discovered that a block was needed for each peak, and as the block location approached the open end, there was reduced output at bass frequencies.

Figure 4:
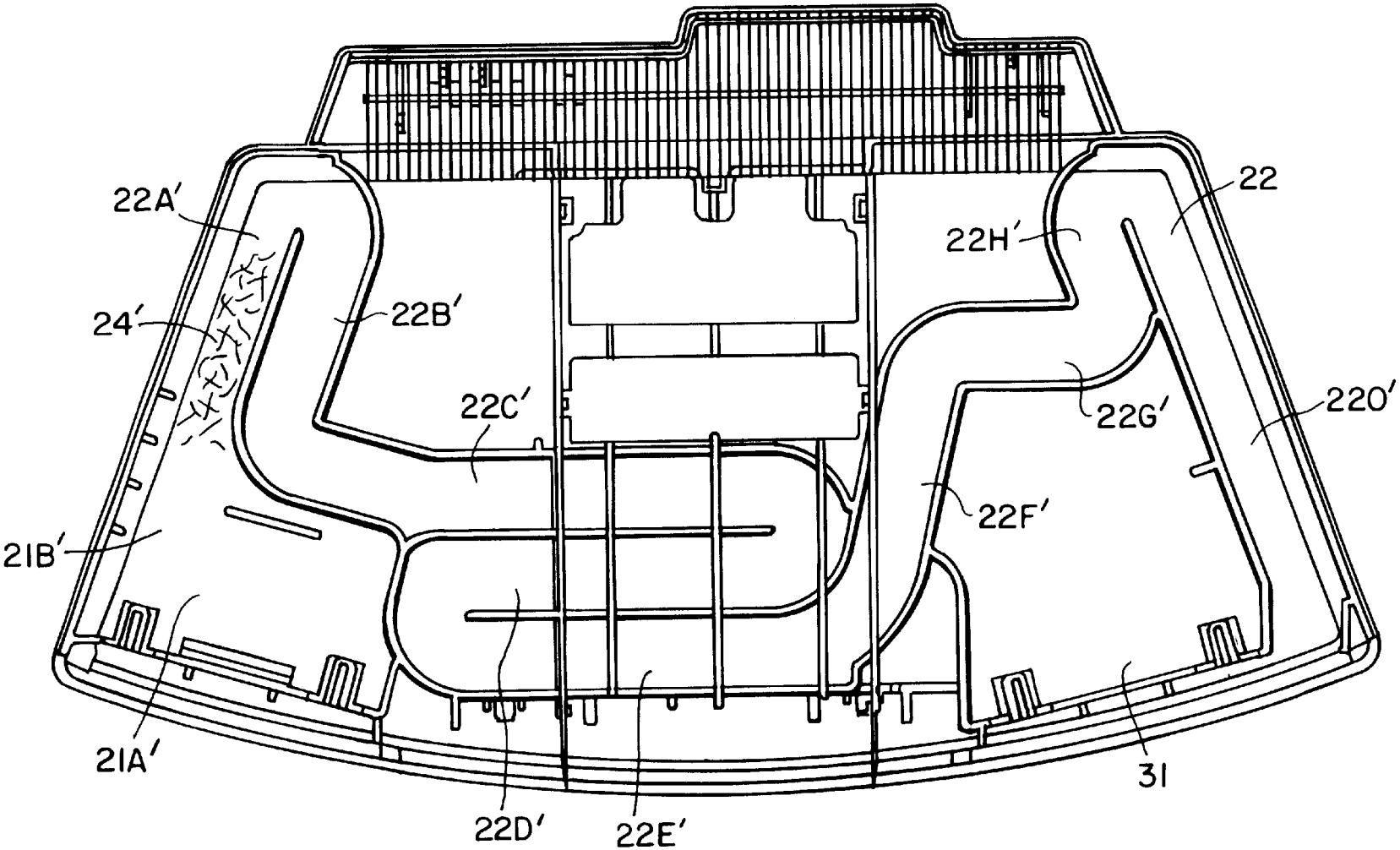
FIG. 4 is a diagrammatic plan view illustrating the structure of an exemplary embodiment of the invention in a stereo receiver cabinet.

By locating the polyester damping material 24 at the driver end as shown, the velocity is low at low frequencies, and the damping material negligibly attenuates bass frequency energy. However, at higher frequencies, shorter wavelengths, the velocity is higher, and the damping material 24 damps these higher frequency peaks as shown in FIG. 3 with a single block of damping material as shown. As seen in FIGS. 1, 2 and 4, the damping material is at the driver end and extends into the waveguide for a predetermined length with the length of the waveguide between the open end and the damping material being significantly greater than the predetermined length.

Referring to FIG. 4, there is shown a plane diagrammatic view of an embodiment of the invention situated in a stereo receiver cabinet. In this embodiment, the plane of driver opening 21A' is angled so its normal or axis points outward to the left and the plane of driver opening 31 is angled so that its normal or axis points outward to the right. This angling enhances stereo reproduction when the left channel driver is seated in opening 21A' and the right channel driver is seated in opening 31. The drivers, or electroacoustical transducers, each have an axis generally perpendicular to an associated vibratile surface with these axes angled slightly away from each other and coinciding substantially with the axes of the respective driver openings 21A' and 31. Waveguide 22 may be regarded as having nine sections in series, 22A', 22B', 22C', 22D', 22E', 22F', 22G', 22H' and 220'. The physical length of these sections is selected to coact with driver cavity 21B' to provide a quarter-wave mode at a predetermined bass frequency, typically 80 Hz.

The particular structural arrangement is especially convenient and fits compactly within a table receiver cabinet. In this embodiment the folded waveguide is of substantially uniform rectangular cross section corresponding to 55–60% of the cross-sectional area 3.91 square inches of driver 21, with the cross section of waveguide 22 being substantially 0.75 inches wide by 2.875 inches high. The length of waveguide 22 from driver cavity 21B' to open end 23 is substantially 34 inches, providing a quarter wavelength mode at substantially 80 Hz.

The structural arrangement of FIG. 2 is also convenient and comprises a plurality of channels 22A, 22B, 22C and 22D formed by shared waveguide walls generally transverse to the diaphragm of driver 21 separated by an output portion 220 by plurality of portions 22E, 22F and 22G formed by shared waveguide walls generally parallel to the diaphragm of driver 21 with output portion 220 formed by waveguide walls generally perpendicular to the plane of driver diaphragm 21A. The terms generally parallel and generally perpendicular or transverse embrace the waveguide walls of FIG. 4 also.

The acoustic waveguide thus comprise plurality of contiguous waveguide portions formed by a first set of waveguide walls generally perpendicular to the diaphragm or vibratile surface and a second set of waveguide walls generally parallel to the diaphragm.

The invention in the form of a single-ended waveguide with a full range driver for one channel of a stereo receiver is especially advantageous for a small table receiver. The bass spectral components from the other stereo channel may be summed and radiated by the invention, typically from 70 to 300 Hz.

What is claimed is:

1. An acoustic waveguide loudspeaker system comprising:

an electroacoustical transducer having a vibratile surface, an acoustic waveguide having a first end open and a second driver end adjacent to said vibratile surface and an effective length corresponding substantially to a quarter wavelength at the lowest frequency of pressure wave energy to be transmitted between said first and second ends, and damping material in said waveguide only at said driver end extending into said waveguide for a predetermined length near said vibratile surface constructed and arranged and positioned so as to negligibly attenuate bass frequency energy while of sufficient volume to damp peaks at higher frequencies above the range of said bass frequency energy, the length of said waveguide between said first end and said damping material being significantly greater than said predetermined length.

2. An acoustic waveguide loudspeaker system in accordance with claim 1 wherein said damping material is polyester.

3. An acoustic waveguide loudspeaker system in accordance with claim 1 wherein said acoustic waveguide comprises a plurality of contiguous waveguide portions formed by a first set of waveguide walls generally perpendicular to said vibratile surface and a second set of waveguide walls generally parallel to said vibratile surface.

4. An acoustic waveguide loudspeaker system in accordance with claim 3 wherein a first of said waveguide portions near said vibratile surface is substantially filled with said damping material.

5. An acoustic waveguide loudspeaker system in accordance with claim 1 wherein a volume of said waveguide nearest said vibratile surface is substantially filled with said damping material.

6. An acoustic waveguide loudspeaker system in accordance with claim 3 wherein a last of said waveguide portions is separated from a first group of said waveguide portions by a second group of said waveguide portions formed by said waveguide walls generally parallel to said vibratile surface.

7. An acoustic waveguide loudspeaker system comprising:

an electroacoustical transducer having a vibratile surface, an acoustic waveguide having a first end open and a second driver end adjacent to said vibratile surface and an effective length corresponding substantially to a quarter wavelength at the lowest frequency of pressure wave energy to be transmitted between said first and second ends, and damping material in said waveguide at said driver end extending into said waveguide for a predetermined length near said vibratile surface constructed and arranged and positioned so as to negligibly attenuate bass frequency energy while of sufficient volume to damp peaks at higher frequencies above the range of said bass frequency energy, the length of said waveguide between said first end and said damping material being significantly greater than said predetermined length, wherein said acoustic waveguide comprises a plurality of contiguous waveguide portions formed by a first set of parallel waveguide walls generally perpendicular to said vibratile surface and a second set of parallel waveguide walls generally parallel to said vibratile surface, wherein a last of said waveguide portions is separated from a first group of said waveguide portions by a second group of said waveguide portions formed by said waveguide walls generally parallel to said vibratile surface, wherein said last of said waveguide portions is separated from said second group of said waveguide portions by a generally L-shaped waveguide portion.

8. An acoustic waveguide loudspeaker system comprising:

an electroacoustical transducer having a vibratile surface, an acoustic waveguide having a first end open and a second driver end adjacent to said vibratile surface and an effective length corresponding substantially to a quarter wavelength at the lowest frequency of pressure wave energy to be transmitted between said first and second ends, wherein said acoustic waveguide comprises a plurality of contiguous waveguide portions formed by a first set of parallel waveguide walls generally perpendicular to said vibratile surface and a second set of parallel waveguide walls generally parallel to said vibratile surface, wherein a last of said waveguide portions is separated from a first group of said waveguide portions by a second group of said waveguide portions formed by said waveguide walls generally parallel to said vibratile surface, wherein said last of said waveguide portions is separated from said second group of said waveguide portions by a generally L-shaped waveguide portion, and a second electroacoustical transducer having a vibratile surface adjacent to the last of said waveguide portions and said L-shaped waveguide portion, said first and second electroacoustical transducers having first and second axes respectively generally perpendicular to an associated vibratile surface, said first and second axes angled slightly away from each other.

* * * * *